US005203116A

United States Patent [19]

Chen

[11] Patent Number: 5,203,116

[45] Date of Patent: Apr. 20, 1993

[54] RAIL ASSEMBLY FOR SLIDING DOOR

[76] Inventor: Hong Jen Chen, #313, 14 Chia, 12 Lin, Da Chih Village Ming Hsiung Hsiang, Chi Yi Hsien, Taiwan

[21] Appl. No.: 879,283

[22] Filed: May 7, 1992

[51] Int. Cl.[5] ..... E05D 15/06

[52] U.S. Cl. ..... 49/404; 16/95 R; 49/425; 49/460

[58] Field of Search ..... 49/404, 425, 420, 421, 49/411, 460; 16/95 R, 96 R, 93 R

[56] References Cited

U.S. PATENT DOCUMENTS

| | | | |
|---|---|---|---|
| 947,019 | 1/1910 | Monnier | 16/95 R |
| 1,814,503 | 7/1931 | Beiger | 49/425 |
| 2,078,811 | 4/1937 | Rouse | 49/425 X |
| 2,538,434 | 1/1951 | Svendsen | 16/95 R |
| 3,138,830 | 6/1964 | Scharge | 49/425 X |

*Primary Examiner*—Philip C. Kannan
*Attorney, Agent, or Firm*—Bacon & Thomas

[57] ABSTRACT

A rail assembly for a sliding door or sliding window includes a plurality of rails having a recess at top portion of each to receive a ball of a guide block therein. A rail cover is provided with a pair of identical troughs on a top portion thereof and in parallel to each other to receive the guide block to extend therefrom. A plurality of paper rolls are provided each having an aperture at one end for attachment to the guide block, and a hole at a center portion to receive a coil spring therein to provide a restoring force to the paper roll. The paper rolls cover the rail when the door or window is not seated on the rail to prevent dust or dirt from blowing into the room or gathering in the rail.

4 Claims, 3 Drawing Sheets

RAIL ASSEMBLY FOR SLIDING DOOR

BACKGROUND OF THE INVENTION

1. Field of the Invention

This invention relates to a rail assembly for a sliding door and more particularly, a rail to guide a sliding door to slide along its track and a rail cover adapted to prevent dust or dirt from coming into the room or from gathering into the track of the rail.

2. Description of the Prior Art

Sliding doors or windows have been widely installed in residences or office buildings for reasons of its convenience in use. But dust or dirt may easily gather on the rail and clog same.

Therefore, the present invention provides improvements to the deficiencies of related prior art rails for sliding doors, as mentioned above.

SUMMARY OF THE INVENTION

It is the primary object of the present invention to provide a rail assembly for a sliding door which has a paper roll or like material to cover the rail and prevent dust or dirt from gathering therein and clogging the rail.

It is another object of the present invention to provide a rail assembly for a sliding door which is provided with a rail cover which prevents dirt or dust from getting into the room.

It is another object of the present invention to provide a rail assembly for sliding door which is easy to install and remove.

It is a further object of the present invention to provide a rail assembly for a sliding door which eases the sliding movement of the door.

It is still a further object of the present invention to provide a rail assembly for a sliding door which is easy to maintain.

DETAILED DESCRIPTION OF THE PREFERRED EMBODIMENT

Figure 1:
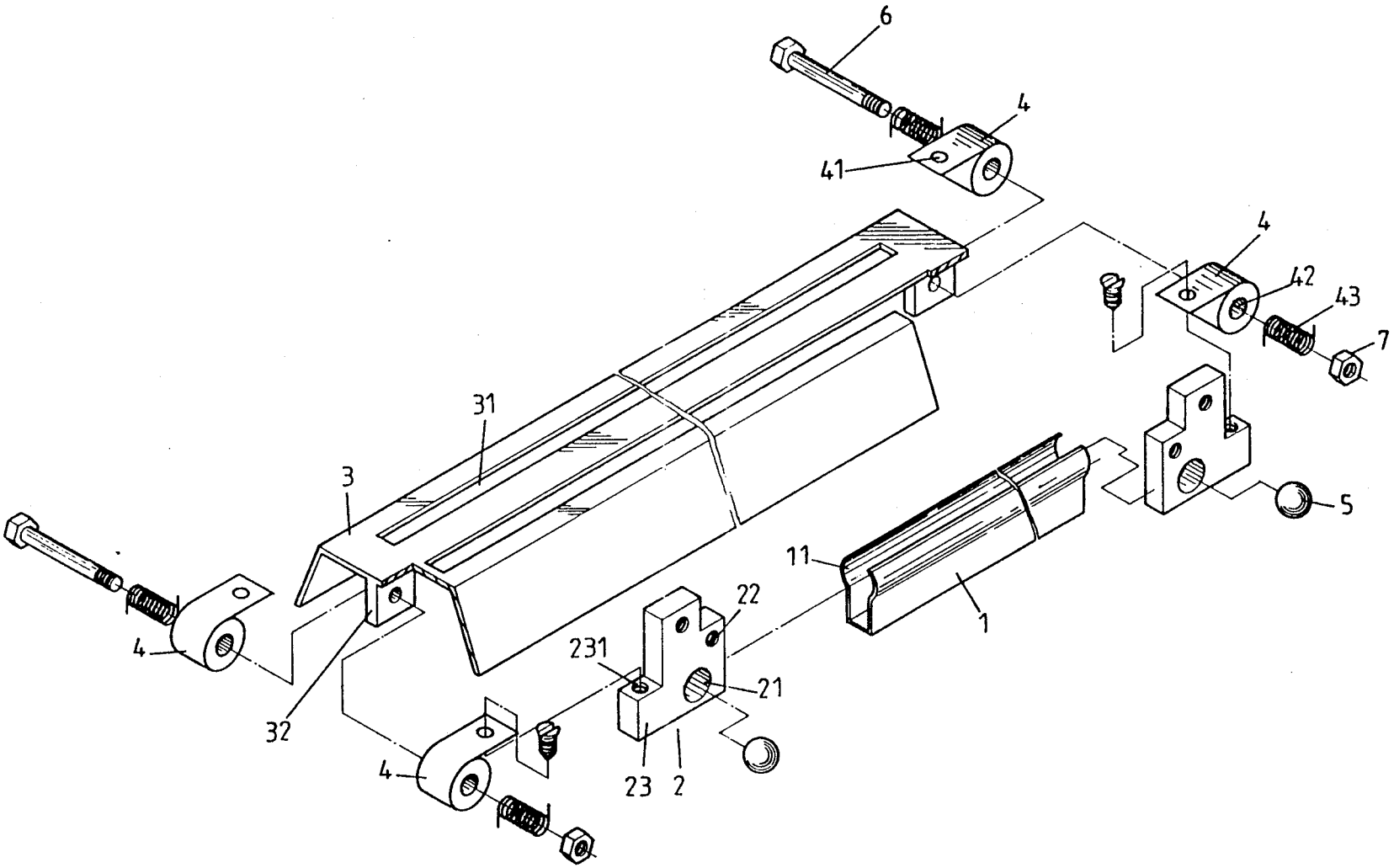
FIG. 1 is an exploded view of the present invention.
Figure 2:
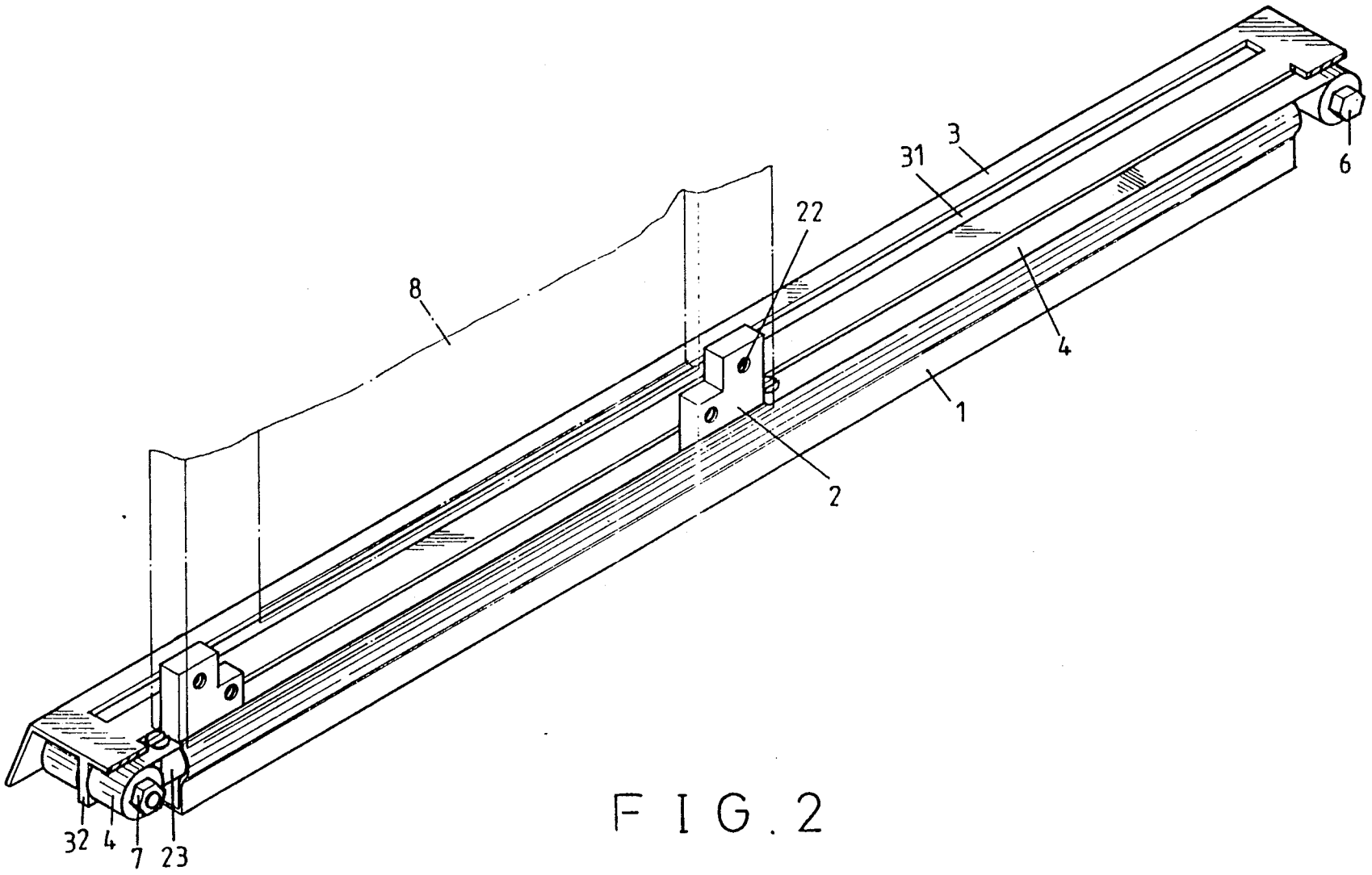
FIG. 2 is a perspective view of the present invention partially sectioned.
Figure 3A:
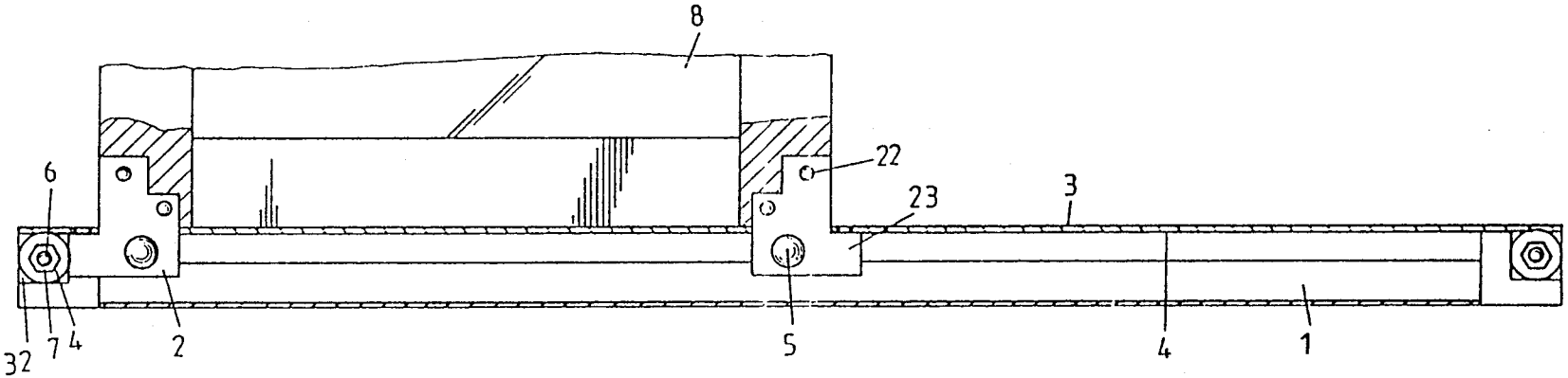
FIG. 3A is a side elevational view of FIG. 1, showing a sliding door slid to one side.
Figure 3B:
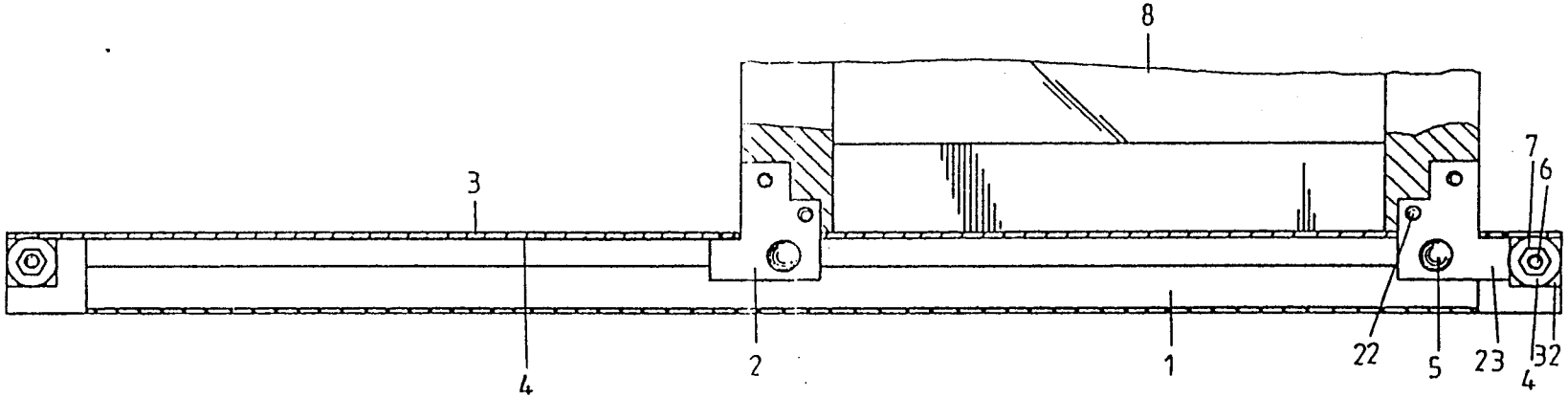
FIG. 3B is a further side elevational view of FIG. 3A showing the door slid to the other side.

Referring now to the drawings wherein the showings are for the purpose of illustrating the preferred embodiment only and not for the purpose of limiting same, FIG. 1 shows the present invention which includes two rails 1, a plurality of guide blocks 2, a rail cover 3, and a plurality of paper rolls 4.

The construction of the rails 1 being similar, only one will be described. The rail 1 is made of a piece of thin material having two wall sections bent upwardly and perpendicularly thereto, the top edges of which being further bent outwardly then inwardly to form a recess 11 therein.

Slidably seating within the recess 11 of the rail 1 is a ball 5 or a roller which is mounted within a through hole 21 of the guide block 2 to facilitate the sliding movement of the guide blocks 2. The guide blocks 2 are of identical construction. The guide block 2 is adapted to be secured to the bottom end portion of a sliding door or window to guide the door or window to slide along the track of the rail 1 by means of screws inserted through two internally threaded apertures 22 and into the frame of the door or window. The guide block 2 further includes an internally threaded aperture 231 facing upwardly therefrom for securing a paper roll 4 thereto.

The rail cover 3 is shaped like a reversed letter "V" having a flat top portion and positioned on top of the guide blocks 2, with two longitudinal troughs 31 along its length and in parallel to each other for the guide blocks 2 to extend therefrom and to slide therealong. Each longitudinal trough 31 is in alignment with and spaced a short distance from the rail 1. Two posts 32 are provided at opposite ends of cover 3 and facing downwardly, each post 32 having an aperture thereon adapted to secure a paper roll.

The paper rolls 4 are of identical construction. The paper roll 4 is provided with an aperture 41 at a free end thereof for securing the paper roll 4 onto the bore 231 of the guide block 2. Ths paper roll 4 further includes a hole 42 at its center portion to receive a coil spring 43 for providing a restoring force to the paper roll 4.

A bolt 6 is inserted through a first coil spring 43 of a first paper roll 4, the aperture of the post 32, the second coil spring 43 of a second paper roll 4 and fastened by a nut at the other end.

Thereby, upon pulling or pushing the sliding door or the sliding window, the guide blocks 2 move along with the sliding movement, and the paper rolls 4, in turn, wind or unwind along with the sliding guide blocks 2.

I claim:

1. A rail assembly for a sliding door or window comprising:

a) a pair of rails, each rail including a pair of upwardly extending wall sections provided with longitudinal recesses therein for defining a ball seat;

b) a rail cover including a flat top portion, a pair of parallel longitudinal troughs formed along the length of the top portion, and a downwardly extending post at each of two spaced ends of the cover;

c) a pair of guide blocks for attachment to the bottom of a door or window extending upwardly through each longitudinal trough for sliding movement therealong, a ball carried by each guide block disposed in sliding engagement within the ball seat of a rail;

d) a pair of paper rolls secured to each post of the rail cover, each roll including a free end secured to a guide block and a restoring spring for rewinding the roll; and e) whereby sliding of a door or window attached to each pair of guide blocks along a rail causes the paper rolls to wind or rewind, thereby covering the rail and preventing debris from accumulating therein.

2. The rail assembly of claim 1 wherein each guide block includes a pair of threaded apertures for attaching the guide block to the bottom of the door or window and an upwardly facing threaded bore for securing the free end of the paper roll to the guide block.

3. The rail assembly of claim 1 further including a bolt and nut assembly for securing each pair of paper rolls to opposite sides of the post and the restoring spring includes a coil spring disposed within a center hole of each paper roll.

4. The rail assembly of claim 1 wherein each guide block includes a through hole, the ball being received within the through hole and the diameters of the through hole and ball being substantially the same.

* * * * *